US005341604A

United States Patent [19]

Wood

[11] Patent Number: 5,341,604

[45] Date of Patent: Aug. 30, 1994

[54] SINGLE BLOCK MOUNTING SYSTEM FOR SURFACING AND EDGING OF A LENS BLANK AND METHOD THEREFOR

[75] Inventor: Kenneth O. Wood, Stafford Springs, Conn.

[73] Assignee: Gerber Optical, Inc., South Windsor, Conn.

[21] Appl. No.: 998,385

[22] Filed: Dec. 30, 1992

Related U.S. Application Data

[62] Division of Ser. No. 604,052, Oct. 26, 1990, Pat. No. 5,210,695.

[51] Int. Cl.[5] ..... B24B 13/00

[52] U.S. Cl. ..... 51/165.71; 51/5 R; 51/284 R; 51/105 LG

[58] Field of Search ..... 51/284 R, 284 E, 5 R, 51/105 LG, 106 LG, 101 LG, 165.71

[56] References Cited

U.S. PATENT DOCUMENTS 2,352,616 7/1944 Canning ..... 51/284 R
3,686,796 8/1972 Clark ..... 51/284 E
4,409,760 10/1983 Nagaura ..... 51/284 R
4,656,590 4/1987 Ace ..... 51/101 LG

*Primary Examiner*—Robert A. Rose
*Attorney, Agent, or Firm*—McCormick, Paulding & Huber

[57] ABSTRACT

A method and related system and article provides a lens blank and block assembly capable of being mounted in any of a surface generating machine, a finishing apparatus and an edging machine without requiring re-blocking of the lens in order to compensate for axis shifts. The method and associated system utilizes a controller which takes data inputted to it in the form of prescription information and a frame opening shape and converts it into two sets of machine operating data together used by a computer to allow the surface to be generated on the blank so as to be readily shaped edgewise according to a selected frame pattern by simply the mounting blank and block assembly in the edging machine thereafter. The blank is separated from the block assembly and readily inserted into a selected glass frame.

29 Claims, 9 Drawing Sheets

SINGLE BLOCK MOUNTING SYSTEM FOR SURFACING AND EDGING OF A LENS BLANK AND METHOD THEREFOR

This is a division of co-pending application Ser. No. 07/604,052 filed on Oct. 26, 1990, now U.S. Pat. No. 5,210,695.

CROSS REFERENCE TO RELATED APPLICATIONS

The present application relates to co-pending U.S. patent application Ser. No. 07/023,473 filed on Mar. 9, 1987 in the name of David J. Logan et al. on METHOD AND APPARATUS FOR MAKING PRESCRIPTION EYEGLASS LENSES, and also to copending U.S. patent application Ser. No. 400,522 entitled METHOD AND APPARATUS FOR EDGING AN OPTICAL LENS filed on Aug. 30, 1989 in the name of David J. Logan, et al. and which applications being commonly assigned with the assignee of the present invention.

BACKGROUND OF THE INVENTION

This invention relates to a method and apparatus for creating a surface on an eyeglass lens blank satisfying given prescription data, which lens blank thereafter being cut about its edges to conform it to a shape to be fitted into a frame in a pair of prescription eyeglasses, and deals more particularly with an improvement in such a method and apparatus wherein from the data normally provided in a prescription, machine operating data are compiled causing a prescribed surface to be cut in the lens and thereafter causing the lens blank to be edged while mounted on the same block used during the surface cutting operation.

A common procedure in making a lens for a pair of prescription eyeglasses is to provide a lens blank, of glass or plastic having two major lens surfaces one of which being a finished surface and the other being one which is worked to satisfy a given prescription for a wearer. Hitherto, prior to surface cutting of the blank to conform it to the given prescription, any cylinder axis called for by the prescription had to be oriented coincidentally with the general horizontal axis of the block. This labor and skill intensive step was to insure that the lens cylinder axis was aligned with the horizontal axis of the lap when the blocked lens and lap were placed in a lapping or fining machine. Maintaining this relationship between the lap tool and the surfaced lens was important in order to effect proper alignment and full working of the total cylindrical surface during the fining or lapping operation. The edge shape of the lens is copied from a pattern mounted on its geometric or box center and on the horizontal axis of the eyeglass frame. Thus, it is necessary to release the original block from the lens and thereafter reblock it with a second block so as to orient the block center and its axis of rotation coincidentally with the box center and horizontal axis of the eyeglass frame. This reblocking process has been known to be very labor and skill intensive in that it requires the skill of technicians to exactly locate and mark critical points on the lens with an inking device and the subsequently attach the new block to the blank using these marked points such that the blank axis of rotation is coincident with the geometric or box center of the lens pattern. Thereafter, the lens blank and the second subsequently attached block are rotated about a common axis of rotation in a edging or cutting machine, which axis also serving as the center point of the pattern or from which the "spokes" defining the amount of radial cut in the blank are referenced.

While some attempts have been made to computerized data preparation, such as disclosed in U.S. Pat. No. 4,656,590 issued in the name of Ronald Ace on Apr. 7, 1987, such systems have nevertheless been unable to continuously maintain a lens blank on a single mounting block throughout the entire operation beginning with the surface cutting operation through to final edging step. Although in other systems, such as disclosed in U.S. Pat. No. 2,352,616 issued in the name of Canning on Jul. 4, 1944, it is known that a lens block may have a disposable portion and may support the lens both during surfacing and edging, it is nevertheless necessary to mechanically shift the support block on the drive of the surfacing machine, the fining machine and/or edging machine to align the block axis of rotation with the desired one of the optical or geometric centers to correctly align the cylinder and horizontal axes. Such mechanical shifting operations introduce additional time into the lens making process and further are the source of possible errors and increased labor costs by requiring a higher degree of skill to be practiced by the technician operating the machine. In addition, the Canning patent requires the use of a permanent holder portion of the lens block. This permanent holder adds a further assembly step to the blocking procedure and introduces a chance for error and misalignment. Further, the permanent holder must be small in diameter to permit edging the lens to fit a very small eyeglass frame without cutting the holder. This prevents the holder from providing solid support for the disposable portion of the lens block and the lens itself during the surfacing operation. Such support is critical to enable accurate generation of the optical surface.

Conventional lens blank and block mounting assemblies have in the past presented other problems and disadvantages with their use. In particular, the surfacing blocks assembled with the lens blank hitherto have for the most part been made of metal. The adhesive used for adhering the lens blank to the metallic block was a low melt metallic adhesive which when applied to the front surface of the lens blank, caused it to be bonded to the metal block as long as the adhesive was not exposed to its melting point, usually equal to about 117 degrees F. One drawback associated with this type of assembly is in the type of metal based adhesive used to secure the metallic block to the blank. Here metals, such as bismuth, cadmium or the like, which have been proven to be hazardous to the health of those working with it are used. In addition, in systems wherein the blank is subsequently remounted to a second, usually metal block used for edging usually after the lapping process, the second block is substantially smaller offering less supporting surface area than the surface area of lens to be supported in order to allow the edging tool to cut the designated path about the lens without interfering with the second block supporting it. Moreover, because the lens blank has now undergone surface cutting and polishing thus making it more susceptible to cracking, the less than adequate support offered by the second block increased the possibility of lens cracking or slipping on the block during the edging operation. Also, in these previously known systems in which double blocking is necessary, each metal block associated with the surface treatment process whether for the purpose of surface cutting or for edging a pattern in the lens could not be mounted to a lens until first being aligned with a required axis to be found from the data supplied by the prescription and the eyeglass frame shape. As such, these metal block and lens blank assemblies could not be put together as preforms and subsequently shipped for storage and inventoried for use at a later point in time when needed. Rather, they were required to be assembled on site according to requirements of the involved prescription to be satisfied. As a result, these known systems experienced drawbacks in the marketplace as well as increasing the time and labor expended by the technician in setting up the block prior to forming the desired surface contour on the involved lens blank.

Accordingly, it is an object of the present invention to provide a method and a related system for both surface treatment and edging of an involved lens blank face using a single disposable and inexpensive block which is one-time mounted to the lens blank before beginning the surface cutting process and is subsequently used throughout the remaining steps of the operation for holding the lens blank in other machines for the purpose of finishing and edging the lens blank thereby avoiding the aforementioned problems associated with previously known systems in which reblocking of the lens blank is necessary.

In keeping with the foregoing object, a more specific object of the invention is to provide a lens making system of the aforementioned type to be used with a lens blank and block assembly wherein means are provided in the system for receiving as input data related to lens surface characteristics and data defining the shape of the frame to be edged, which data in-turn being used to create numeric machine operating language for instructing automated tools for cutting a prescribed surface contour in the lens blank and thereafter for edging the blank to conform it to a particular shape to be fitted within an opening in a selected frame while using the original lens blank and block assembly.

Still a further object of the present invention is to provide a system and a method whereby using a single blocking step, and a given frame shape taken in conjunction with an ophthalmic prescription surface, lenses for an eyeglass pair are quickly fabricated without requiring excessively skilled operators.

Still a further object of the present invention is to provide a novel block for use in a lens blank and block assembly having means for mounting it to a variety of different tools for working a lens blank during surfacing, polishing and edging operations.

It is still a further object of the present invention to provide a block capable of totally supporting the prefinished surface of a lens blank mounted to it while nevertheless being capable of allowing excess lens material to be cut away with it during an edging operation in order to create the selected shape for fitting into a frame.

A further aspect of the invention lies in a lens blank and block assembly wherein the lens blank is attached to the block through the intermediary of an adhesive bonding means which adhesive bonding means being generally non-toxic to its user and being capable of being stored for prolonged periods, such as in inventory.

Still a further object of the present invention is to provide a numerically controlled machine of the type having a memory in which data stored as numeric machine operating code defines a number of different frame patterns, a selected one of which patterns being chosen and used to control the movements of an edging tool to cut a designated frame pattern into the lens blank and block assembly.

A further object of the present invention is to provide a quick release mounting means for a lens blank and block assembly used in a lens surface cutting apparatus such that the lens blank and block assembly is readily mountable to a rotating chuck in a single orientation thereby further reducing the time and mistakes otherwise associated with mounting of the lens to a surface cutting machine.

Other aspects and objects of the invention will become apparent from the following disclosure and appended claims.

SUMMARY OF THE INVENTION

The invention resides in a system and a related method for making a prescription eyeglass lens for an individual and for a particular selected eyeglass frame having two lens openings each having a vertical reference line and a horizontal reference line and which two lens openings being horizontally spaced from one another by a horizontal distance measured between the vertical reference lines.

For this, a lens blank and block assembly is provided and includes a lens blank having a block fixed to it, the lens blank has a generally spherical front surface and a rear surface, the block being fixed to the front surface, and the block having engagement means for engagement by a holding means which engagement means locates a first reference axis fixed relative to the lens blank and block assembly extending through the center of curvature of the spherical front surface of the lens blank and a second reference axis fixed relative to the lens blank and block assembly and located in a plane perpendicular to the first reference axis and intersecting the first reference axis. A set of prescription information defining the optical characteristics of a lens to be produced from the lens blank is provided as well as a set of frame opening shape data defining the edged shape of the lens to be produced from the lens blank to suit it to the associated lens opening of the selected frame. Additional information provided to the system includes data defining the interpupilary spacing of the particular user and data defining the horizontal spacing between the two lens openings of the selected frame. The system processes the data in a computer to generate a first set of machine operating data defining with reference to the first and second reference axes a shape to be given to the rear surface of lens to cause the lens blank to have the optical characteristics specified by the prescription data and frame data and to also generate a second set of machine operating data defining with reference to the first and second reference axes the edged shape to be given the lens cut from the lens blank such that the first and second sets of machine operating data being so related to one another that the lens defined by the first and second machine operating data when fitted into the associated lens opening of the selected frame will have its optical characteristics properly located relative to the associate eye of the particular user when the frame is worn by the user. The lens blank and block assembly is placed in at least one machine and held by the engagement means to locate the first and second reference axes of the assembly relative to related axes of the machine and then the machine operating data is used to convert the rear surface of the lens blank into an optically finished one giving the lens blank the optical characteristics required by the prescription and frame data. The lens blank and block assembly is then placed into at least one other machine and held by the engagement means to locate the first and second reference axes of the assembly relative to related axes of the other machine and then the other machine is operated under the control of the second set of machine operating data to cut an edged lens from the lens blank having an edged shape conforming to the shape of its associated lens opening of the selected frame and positioning the optical surfaces properly relative to each eye. The block is then removed from the finished and edged lens.

The invention more broadly resides in a system employing the aforementioned lens blank and block assembly wherein the assembly is mountable in a surface polishing machine for off-axis polishing or finishing of the rear surface of the lens as originally fixed to the block by providing a custom and matching lap blank, the cylinder axis of which is set to match that formed on the lens fixed to the block.

The invention further resides in a lens blank and block assembly in which a lens blank having a generally spherical front surface and a rear surface is provided and is fixedly mounted to a block having a base portion and a generally cylindrical body portion integrally connected therewith. The generally cylindrical body portion has a spherical indentation formed in it correspondingly sized and shaped to receive the generally spherical front surface of the lens blank. The lens blank and block are held together by a layer of bonding material interposed between the lens blank front surface and the generally spherical indentation formed in the cylindrical body portion.

The invention further resides in a chuck for use in a lens surface cutting machine rotatable about a given axis and adaptable for mounting different articles to be worked on in the machine. The chuck has a generally planar support surface for engaging with and supporting an article held against it and has a generally cylindrical opening extending from the support surface axially inwardly and oriented concentrically with the axis of rotation of the chuck. Means are provided for communicating air through the generally cylindrical opening to cause air to be drawn through it to a vacuum source. The articles are automatically oriented with respect to the first and second reference axes by locating means carried on the chuck which means includes means for quickly mounting and dismounting an article.

DETAILED DESCRIPTION OF THE PREFERRED EMBODIMENTS

Figure 1A:
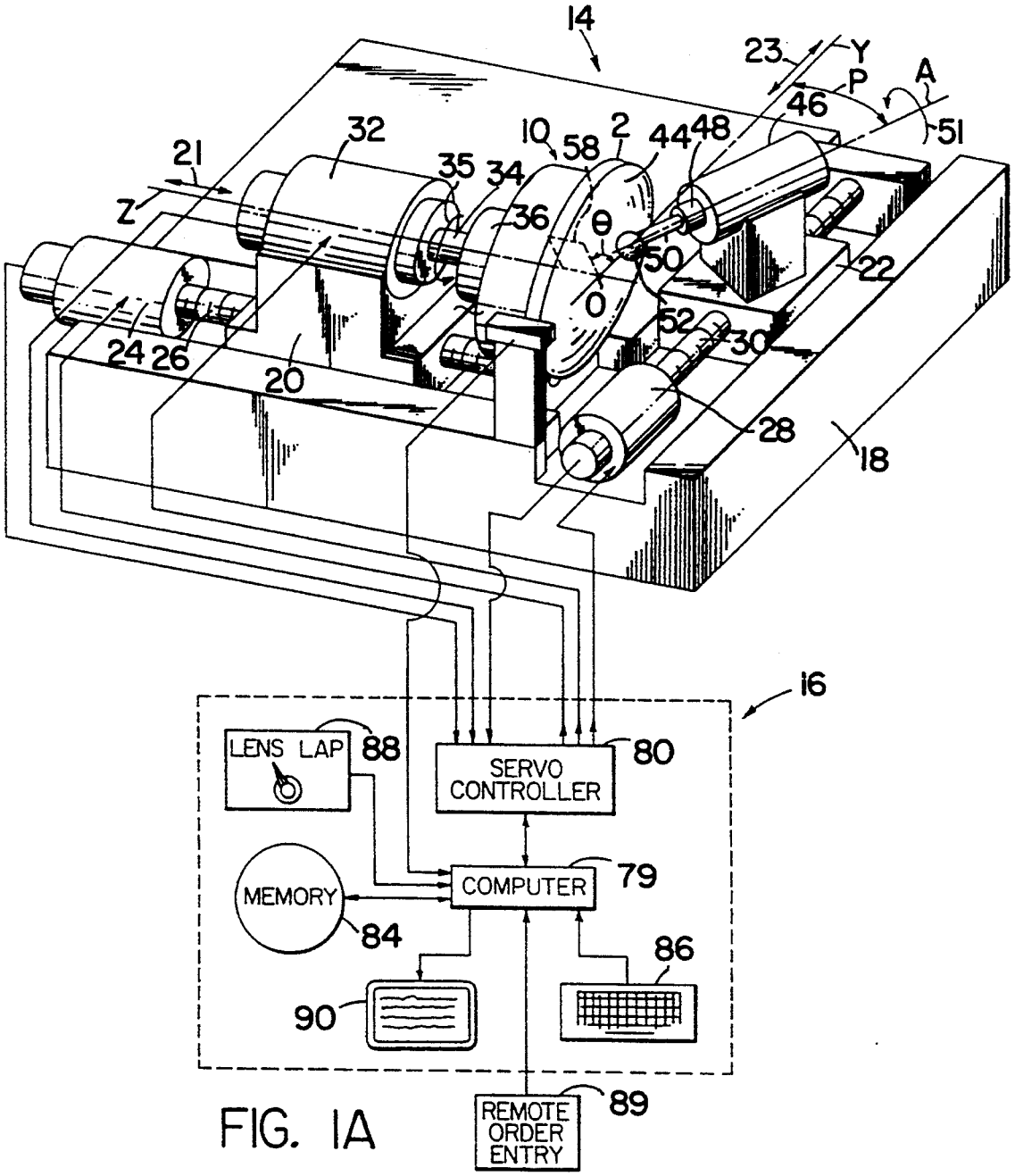
FIG. 1A is a view showing a three-axis cutting machine in an associated control system for cutting a prescription related surface on a lens blank or lap blank, the machine being shown somewhat schematically and the control system being shown in block form, the machine being shown in the process of cutting a lens blank.
Figure 1B:
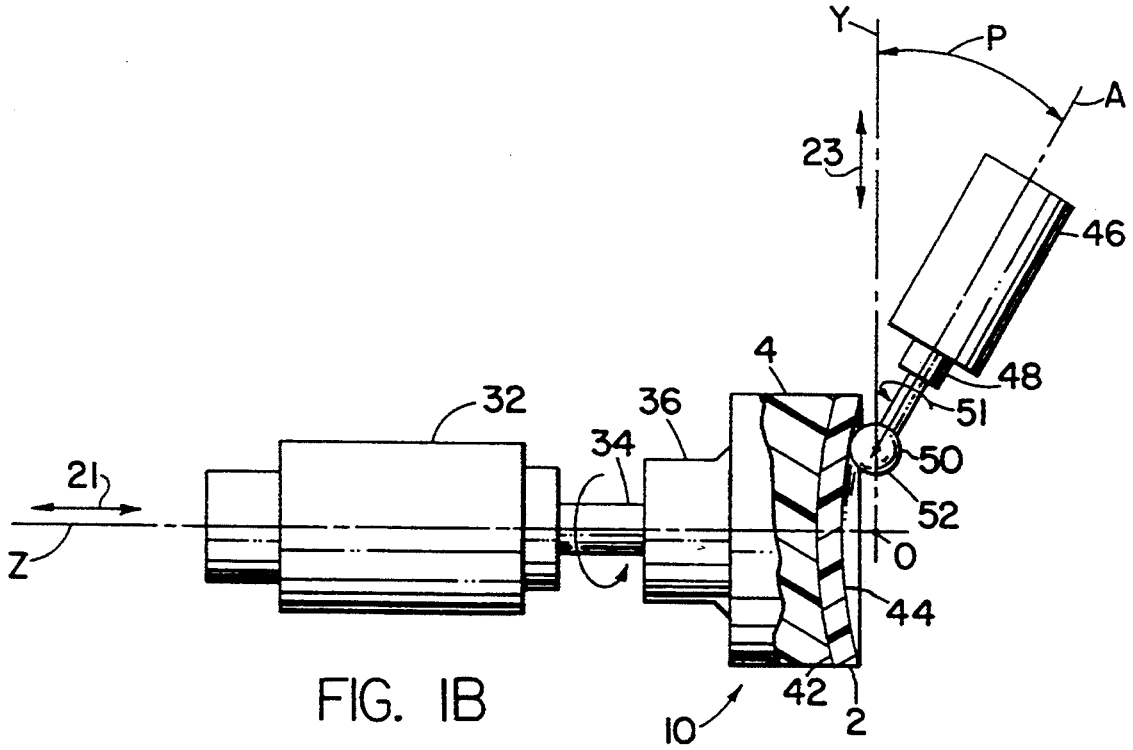
FIG. 1B is a plan view of a portion of the machine of FIG. 1A with part of the lens blank and holding block being broken away to better reveal the cutting tool.
Figure 2:
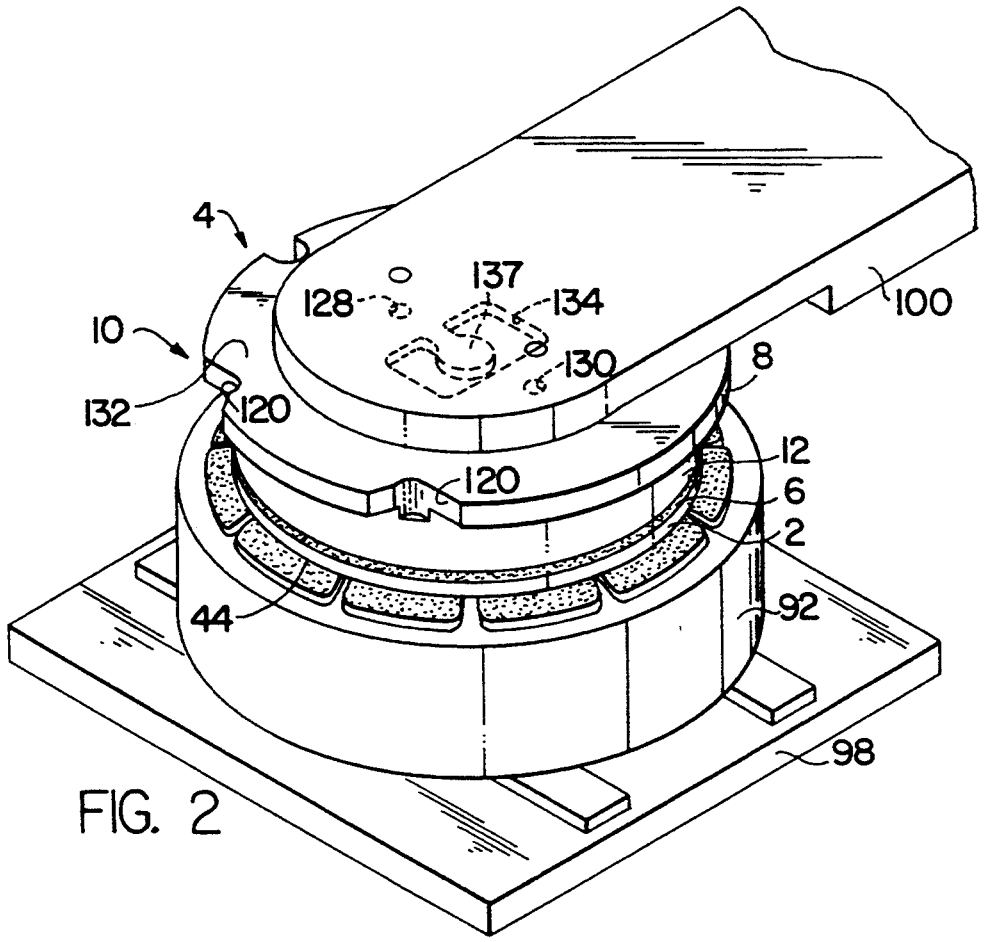
FIG. 2 is a perspective view of the lens blank and block assembly mounted in a finishing machine to polish the worked surface of the lens blank of FIG. 1A.
Figure 5:
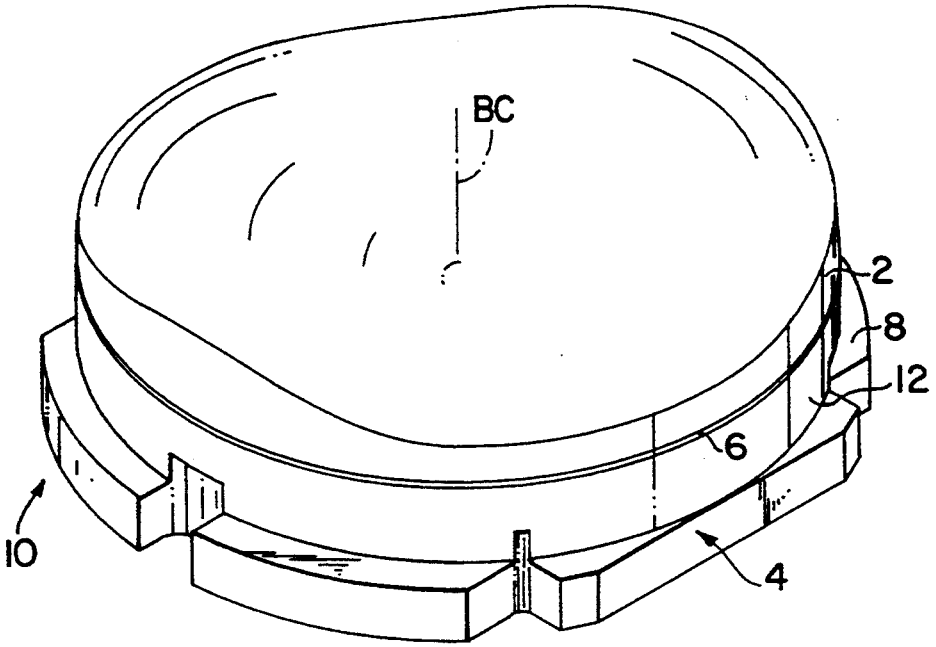
FIG. 5 is a perspective view of the lens blank and block assembly.

The present invention resides in a system and a related method for cutting one surface of a lens blank to satisfy a given prescription and thereafter edging the lens blank to conform it to a desired shape while it is still mounted on the same block used in the surface cutting process. For this, a lens blank and block assembly 10 is provided as illustrated in FIG. 5 for use in combination with a system having a lens surface cutting machine depicted in FIGS. 1A and 1B, a finishing or polishing apparatus as shown in FIG. 2 and lens edging machine illustrated in FIGS. 3A and 3B, each of which machines having means cooperating with corresponding mounting means formed on the lens blank and block assembly 10 for holding the assembly in place during a respective operation.

The surface cutting machine 14 shown in FIG. 1 is generally of the type disclosed in the aforementioned copending U.S. patent application Ser. No. 07/023,473 filed on Mar. 9, 1987 entitled METHOD AND APPARATUS FOR MAKING PRESCRIPTION EYEGLASS LENSES, which application being hereby incorporated by reference in the present application. The machine 14 as employed in the system embodying the present invention, includes a base 18, a first slide 20 and a second slide 22. The first slide 20 is supported and guided by the base for translational movement relative to the base parallel to the illustrated Z axis as indicated by the arrow 21, and the slide 22 is supported and guided by the base for translational movement parallel to the illustrated Y axis as indicated by the arrow 23. The Y and Z axes intersect at the point O. The slide 20 is driven parallel to the Z axis by an associated servomotor 24 and lead screw 26. The slide 22 is similarly driven parallel to the Y axis by an associated servomotor 28 and lead screw 30. A third servomotor 32 having an output shaft 34 collinear with the Z axis drives the shaft about the Z axis as indicated by the arrow 35. As will become more apparent later in accordance with another aspect of the invention, the end of the shaft 34 not associated with the servomotor 32 carries a chuck 36 adapted for holding the lens blank and block assembly 10 for rotation about the Z axis in the indicated rotational direction. For this the shaft 34 is configured to allow a vacuum source to communicate through it and into the chuck 36 for drawing the assembly 10 into engagement with it.

The lens blank and block assembly 10 is comprised of a block 4 and a lens blank 2 initially having two major surfaces 42 and 44 both of which are usually spherical. In the illustrated example of FIG. 1B, the surface 44 is cut and finished to give a changed shape causing the blank to satisfy a given prescription. The unworked surface 42 as will become apparent later, is releasably bonded to the block 4, bug remains fixed to it during the entirety of the operation constituted by the cutting of the surface 44 and the subsequent edging of the blank to fit a particular frame pattern.

The slide 22 carries a rotary cutter comprised of a drive motor 46, a chuck 48 and a cutting tool 50. The cutting tool has a spherical cutting surface 52 with a center of curvature positioned along the Y axis. The motor 46 rotates the tool 50 at a high speed in the indicated direction 51 about an axis A passing through the center of curvature of the tool head.

Three tool point coordinates of any given tool point are reproducible by the machine 14, namely (y, z, theta). One of these coordinates is a y coordinate measured parallel to the Y axis and is the displacement in that direction of the tool point in question from the origin O of the Y and Z axes. Another coordinate is the z coordinate measured parallel to the Z axis and is the displacement in that direction of the tool point in question from the origin zero. A third coordinate is an angular coordinate theta measured about the Z axis and is the angular displacement of the tool point in question from a reference plane 58 fixed relative to the assembly 10 and containing the Z axis. Thus, it should be understood that the surface cut on the mounted blank in response to the tool point data inputted to the machine may be of any reasonable shape as required by the prescription and may indeed be a toric shape or even a more complex shape wherein the intersection of the surface with the planes perpendicular to the Z axis are non-circular. That is, a prescription for a lens, as stated for example in terms of "sphere", "cylinder" and "prism" values (or perhaps different and/or additional values), and given information as to the index of refraction and curvature of the unworked lens blank surface, is data which can be converted to a set of point data in the form of a first set of numeric machine operating data consisting of three coordinates for each of a large number of points located on and distributed over the desired surface, and therefore defining that surface.

The control system 16 for the machine 14 may vary widely as to its detail but basically and as shown in FIG. 1 it is comprised of a servocontroller 80 which may itself contain a microprocessor, a computer 79 and a computer memory 84. A means is also included for entering prescription information and other data which may be needed to allow the conversion of the prescription information to point data dictating generation of the proper surface on the involved blank. The exact nature of the data input means may also vary without departing from the invention, but in a typical case and as shown in FIG. 1 it is either a local order entry means, such as a keyboard 86, a remote order entry system, or computer or data link comprising a remote order entry means 89. As will be seen later, a mode selection switch 88 is provided and is manually set to either a lens surface generating mode or to a lap surface generating mode according to whether the operator is cutting a lens blank or a lap blank in accordance with a further aspect of this invention. A read-out means such as a CRT display device 90 or the like may also be included in the system to allow the computer to supply instructions and requests for information to the operator as well as providing a data check for that information inputted into it by the operator.

The machine 16 is also capable of custom forming a lap blank 92 used for polishing or finishing the surface 44 of the lens blank 2 in a finishing machine depicted in FIG. 2 in accordance with an aspect set forth in the aforementioned U.S. patent application Ser. No. 07/023,473. The customizing of disposable lap blanks herein employed in the system which replaces the aforementioned premanufactured fixed axis laps previously used and method of the present invention frees the assembly 10 from the otherwise rigid blocking procedure which prior to this required the orientation of any cylinder axis formed on the lens blank to be coincident with the finishing machine horizontal axis for purposes of the lapping procedure. Consequently, and as shown more particularly in FIG. 2, the custom fit lap blank 92 together with the lens blank and block assembly 10 are together held in engagement by the two members 98 and 100 of the illustrated finishing machine which may be any one of a number of standard machines used for this purpose. That is, the lap 92 being formed by the machine 14 with a convex surface mirroring the inverse of points defining the work surface 44 on the lens blank 2 allows the lap and the block assembly to be mounted together in the finishing device irrespective of the orientation of the cylindrical axis which before this required the aforementioned special relationship to be established. As a result of this, the assembly 10 can thus be mounted to the upper member 100 of the finishing machine for oscillation relative to the lap 92 through the intermediary of the conventional mounting means carried by the member 100 engaged with the assembly 10 by means hereinafter discussed respect to the description of the block 4. For the moment however it should be understood that the system of the present invention thus allows for off-axis polishing of the lens blank permitting the prescription surface formed on the lens to be made with respect to a selected frame pattern rather than to the contour of a lap which prior to this were not custom fitted to the surface cut in the lens blank with regard to the cylinder axis.

Figure 3A:
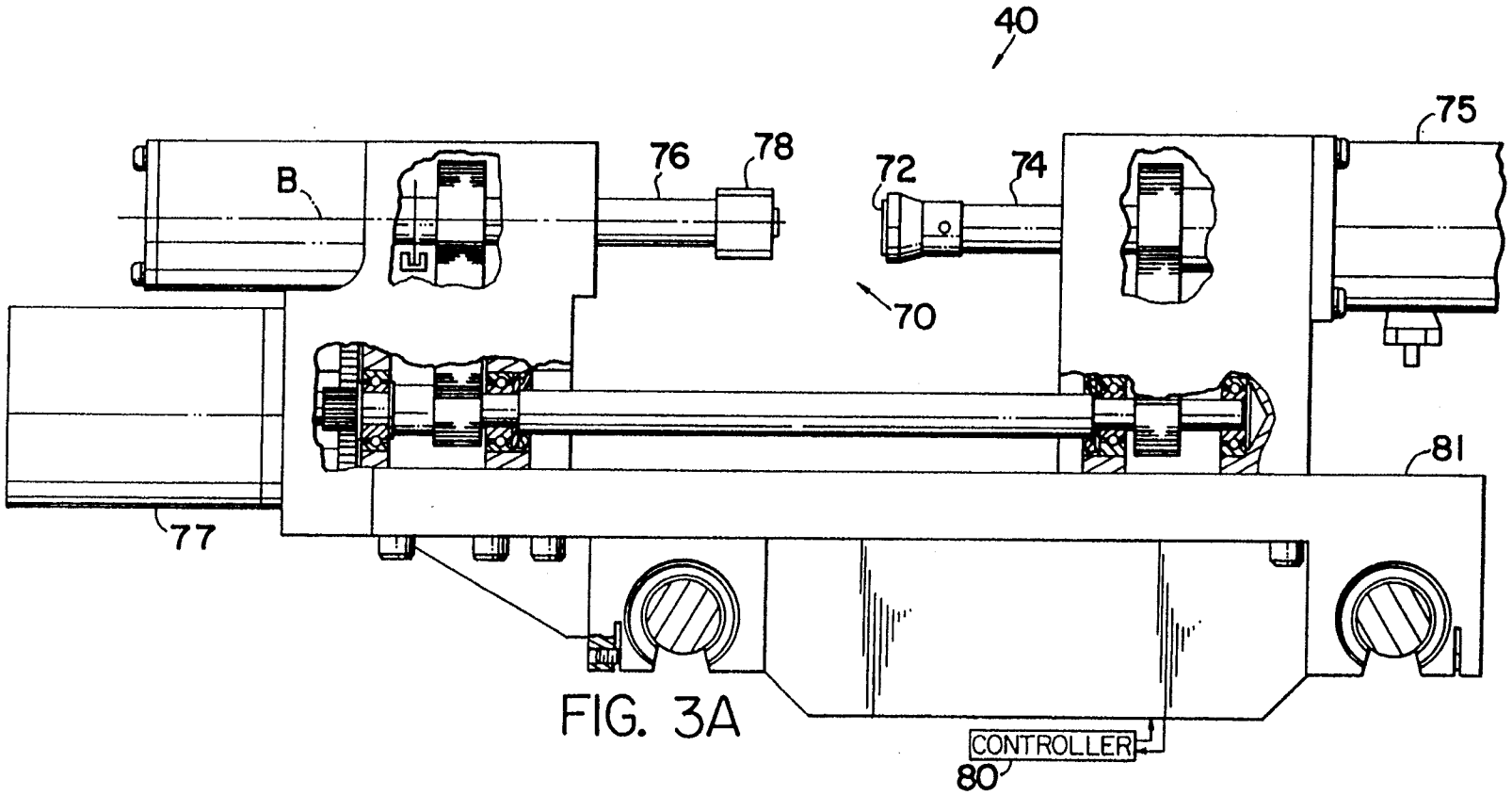
FIG. 3A is a side elevation view of an edging machine on which the lens blank and block assembly is mounted for cutting a lens shape pattern edgewise in the assembly.
Figure 3B:
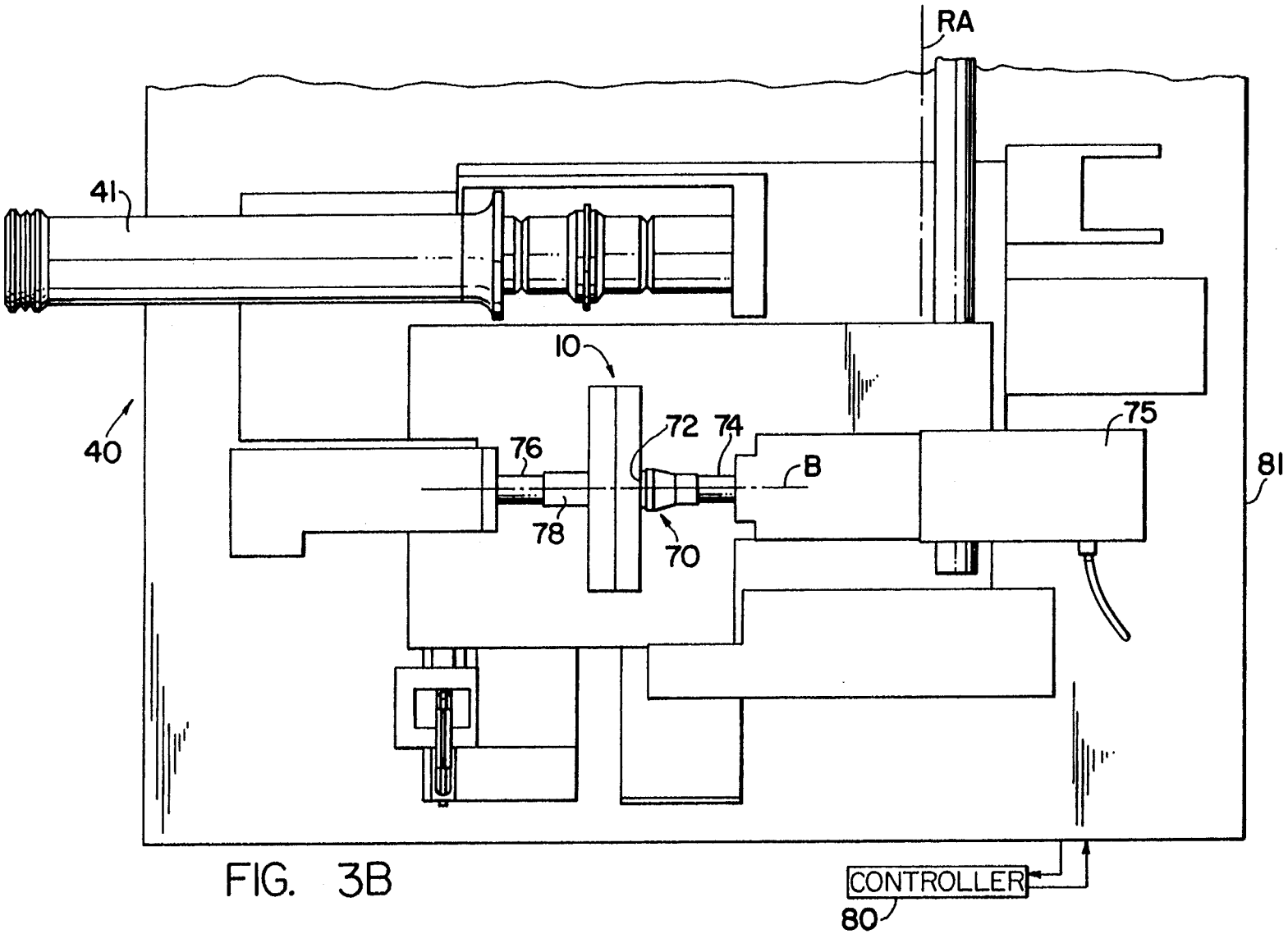
FIG. 3B is a top plan view of the edging machine of FIG. 3A shown with the lens blank and block assembly mounted to it.

The edging machine shown generally as 40 in FIGS. 3A and 3B may be one such as disclosed in co-pending U.S. patent application Ser. No. 07/400,522 filed in the name of Logan et al. on Aug. 30, 1989 entitled METHOD AND APPARATUS FOR EDGING AN OPTICAL LENS, which application being commonly assigned with the assignee of the present invention and being hereby incorporated by reference. For mounting the lens blank and block assembly 10 to the edging machine 40 a pressure pad clamping mechanism 70 is provided and includes a pressure pad 72 fixed to a rotating first spindle 74 and a mounting chuck 78 mounted to a second spindle 76 each of which spindles being drivingly rotated in unison with one another about a common axis of rotation B by a drive servo motor 77. In accordance with one aspect of the invention, the mounting chuck 78 is adapted to nonrotatably drivingly engage the lens blank and block assembly 10 and is held against rotational movement with it under the biassing force of the pad 72 moved and held in engagement with the surface 44 of the blank by a piston means 75 acting along the axis B. The first and second spindles 74 and 76 are drivingly mounted on a carriage 81 for movement along the indicated RA directional axis in accordance with instructions issued to appropriate drive means (not shown) by a controller 80 having a microprocessor and a memory similar to that discussed with reference to the surface cutting machine 14 in FIG. 1. For cutting a desired pattern shape into the lens blank and block assembly 10, a rotating cutter spindle 41 is provided and during an edging operation is brought into engagement with the lateral outer edges of the lens blank and block assembly 10 by the controlled relative movements of the carriage 81 and the cutter spindle along the indicated RA directional axis such that the edge of the assembly 10 is cut in a radial direction by the cutter spindle a predetermined amount in accordance with a second set of machine control data discussed in greater detail with reference to the preblocking procedure of FIG. 7. For the moment it is only necessary to appreciate that the controller 80 has a memory in which is transferred the second set of machine control data relating the shape of the selected frame to the axis B for use in the edging process in the machine 40.

Figure 4:
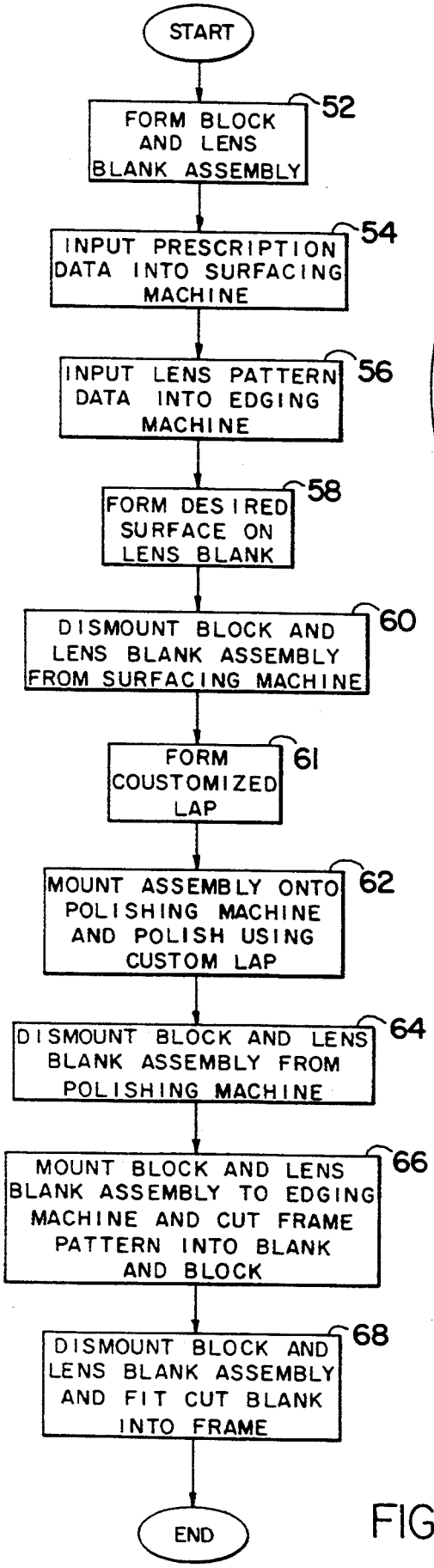
FIG. 4 illustrates a flow chart for practicing the method of the present invention whereby the lens blank and block assembly is cut and worked on by the machines of FIGS. 1–3.

In FIG. 4 the method by which the machines illustrated in FIGS. 1–3 are used together as a system and in connection with the lens blank and block assembly 10 is summarized. The assembly 10 is first formed (step 52) by adhesively bonding the lens blank 2 to the block 4 such that the geometric centers are aligned and once cured the adhesive fixes the two parts to one another such that they may be used immediately or stored for later use. No particular angular relationship is required to be established between the block and the blank here, except in the instance where a multifocal lens is involved in which case alignment is needed as will be discussed in greater detail later with respect to the discussion related to FIG. 7. Thereafter, the first data set corresponding to the prescription to be satisfied, including such parameters as "sphere", "cylinder" and "prism" values (or perhaps different and/or additional values, such as vertically moving the optical center off the lens horizontal axis) are inputted into the controller 16 of the cutting machine 14 (step 54). Along with this data are inputted the second data set describing the pattern of the frame selected, including such parameters as the frame shape in terms of polar coordinates taken relative to a reference point and the distance between the geometric centers of each frame opening step 56). From this data taken as a whole, the desired contour is cut in the surface 44 of the lens blank 2 to satisfy the involved prescription (step 58). After this, the assembly 10 is dismounted from the cutting machine 14 (step 60) and the customized lap 92 is formed using the inverse of the points that defined the surface cut into the lens blank (step 61). Both the assembly 10 and the customized lap are readily mounted in a finishing machine for polishing of the surface 44 (step 62). Thereafter, both pieces are dismounted (step 64) and the assembly 16 is then mounted in the frame pattern edging machine 40 (step 66) to effect cutting of a desired frame pattern in the blank 2 using the information from the second data set. The finished, edged lens need only be separated from the block 4 supporting it and thereafter placed into the intended frame opening (step 68).

Figure 6:
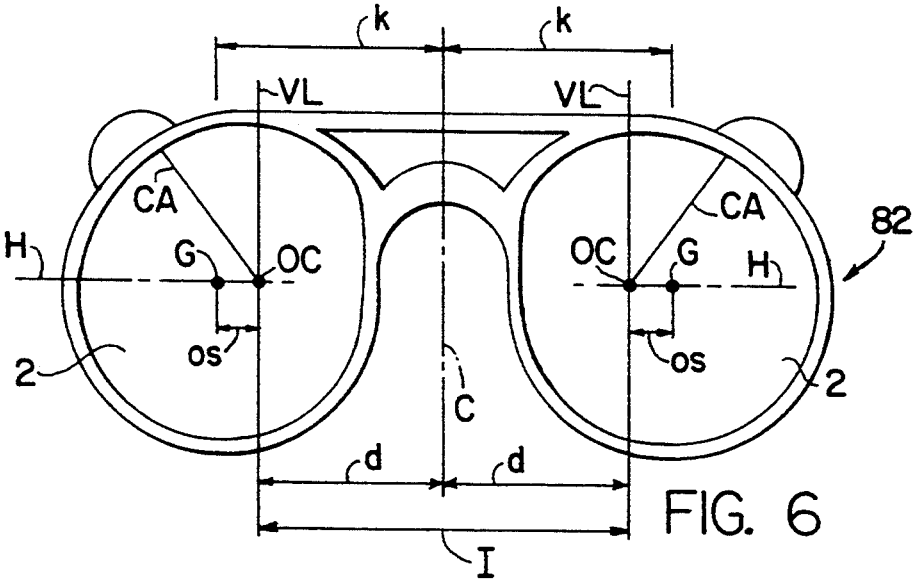
FIG. 6 is a plan view of an eyeglass frame on which is marked for reference purposes data necessary for satisfying a prescription.
Figure 7:
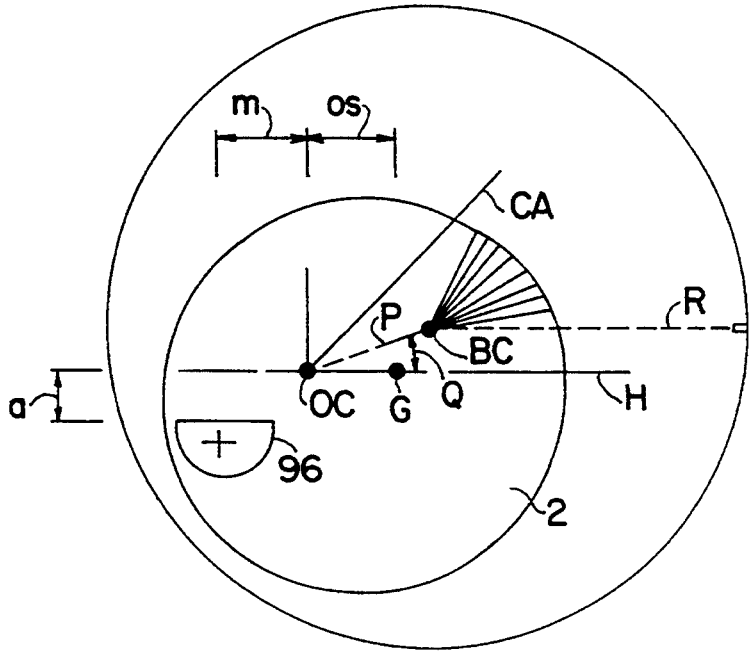
FIG. 7 illustrates an arrangement of prescription data on a lens blank by the surface cutting machine of FIGS. 1A and 1B before the surfacing operation.
Figure 8:
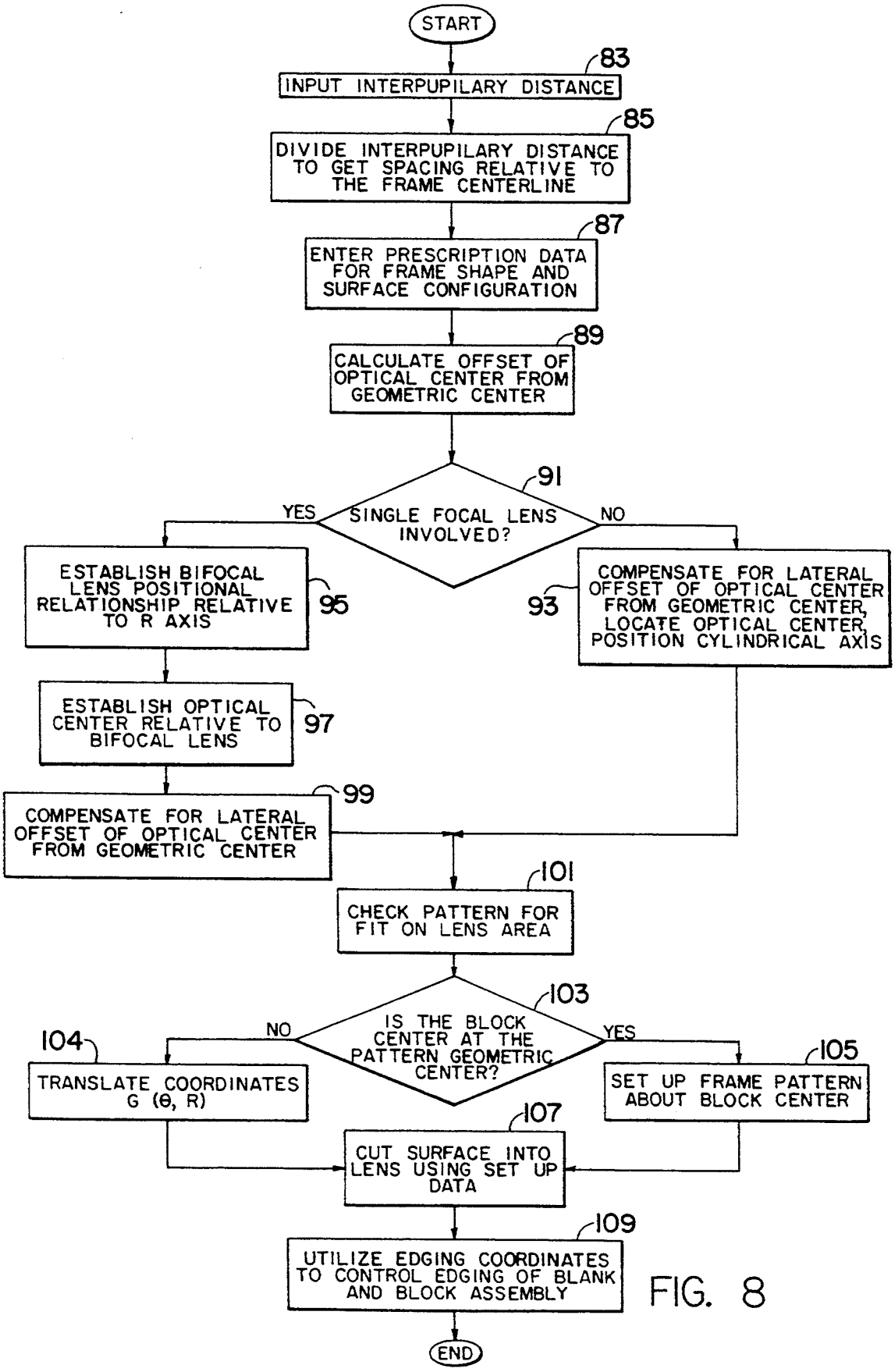
FIG. 8 is a flow chart of the steps followed in the data input process and subsequent manipulation of the prescription and frame shape data to arrive at the illustrated surface arrangement of FIG. 7.

Referring now to FIGS. 6–8 a method is disclosed by which the surface 44 of the lens blank 2 is cut to satisfy the involved prescription along given y, z, and theta coordinates set up in the machine 14 so as to allow a selected frame pattern to be readily cut into the lens blank 2 by the edging machine 40 without reblocking. It should be seen that for a given eyeglass frame, indicated as 82 in FIG. 6, parameters relating the frame shape to the physical characteristics of the user are first established. For this, interpupilary spacing I is measured relative to two vertical lines VL each in coincidence with the pupil of the wearer. The dimension I is part of the prescription and is determined by the ophthalmologist or other skilled professional during the eye exam. This distance is inputted to the controller 16 (step 83) and in order to establish individual pupilary distance taken relative to the centerline C of the desired frame is divided by 2 which dimension being hereinafter referred to as d (step 85). Each frame pattern has a geometric center G through which a horizontal axis H divides the pattern vertically into two parts. The geometric center can be determined typically by boxing the pattern to locate it or may alternatively be constituted by a reference point not necessarily geometric center point from which a polar coordinate used to define the frame shape is referenced.

A data base in the memory 84 of the controller 16 includes information for a frame design defined by a plurality of "spokes" or radial coordinates, usually on the order of 400 for a 360 degree pass, emanating from the geometric center g of a given pattern. Similarly, the lens blank and block assembly 10 has a block center BC which is coincident with the lens blank geometric center and a first reference axis fixed relative to the assembly extending through the block center BC. It should be understood here that the geometric frame center G is not normally oriented coincidentally with the block center BC and therefore adjustments to the frame pattern information are made arithmetically by an appropriate algorithm in the controller 16 in accordance with a further aspect of the present invention.

The prescription and frame shape data are next entered (step 87) in accordance with the parameters previously enumerated with reference to steps 54 and 56 in FIG. 4. Included in the frame shape data is information setting forth the distance from the centerline C that the geometric centers G are located as indicated in FIG. 6 by the dimension k. From this information, any difference in value between dimensions d and dimension k is determined, hereinafter referred to as dimension os, and thereafter is considered as an offset and accounted for in subsequent calculations (step 89). Here, the prescription data is now related to the block center BC and to a second reference axis R which includes .the block center BC fixed relative to the lens blank and block assembly 10. Although the method is capable of accommodating single or multifocal lenses, a determination is nevertheless made (step 91) to establish the lens type involved because surfacing a multifocal lens requires the further orienting of the prescription surface relative to the secondary lens. If only a single focal lens is involved however, the selected pattern shape is numerically set up in the computer relative to the fixed axes BC and R while simultaneously accounting for the orientation of the cylinder axis CA with respect to the horizontal axis H and accounting for any offset amount os which may exist between the optical center OC and the geometric center G (step 93). Although the method of this invention permits freedom in locating the block center for single focal lens including making the block center BC coincident with the geometric center G, the requirement that the lens blank circumscribe the frame pattern may limit choice in the relative locations of these points. In such situations, the data defining the frame shape is altered (step 104) so as to make the reference point of the information defining the selected frame shape coincident with the block center BC rather than at the geometric center G as will hereinafter be discussed in greater detail.

As shown in FIG. 7, when a multifocal lens in involved, the horizontal axis H is usually located somewhat below the block center BC and is so oriented relative to the reference axis R as to extend generally parallel to it. This relationship is accomplished by initially fixing the multifocal lens on the block 4 such that the upper edge of the secondary lens 96 extends generally parallel to the axis R and provides an angular origin from which the remaining prescription may be taken (step 95). That is, the optical center OC of the primary lens is established above the secondary lens 96 at a vertical distance indicated by the dimension a and is established laterally relative to it at a horizontal distance indicated by the dimension m, each of which dimensions being set forth as part of the data comprising the prescription to be satisfied (step 97). With the optical center OC now established relative to the secondary lens 96, the geometric center for the selected frame shape is thereafter located using the offset dimension s to establish this point (step 99). It is further noted that while horizontal offset os is normally compensated for, when required, vertical offsets of the optical centers OC relative to the axis H may also be accommodated in a similar manner.

With the optical and geometric center of the lens surface now established whether in a single or multifocal lens type, a check (step 101) is made to determine whether a selected pattern will fully fit within the lens area. If such a fit is not possible given the area of the surface 44, a different lens blank or frame may have to be selected. If however the selected pattern shape can be fitted, then the program next checks whether the selected frame shape has its geometric center G coincident with the block center BC (step 103) and if so, allows the frame pattern data to be used unaltered (step 105) in the edging step 109 with the further result being that the machine 14 can now begin cutting of the lens surface 44 (step 107). If this is not the case, then the coordinates representing the selected frame pattern presently based on the geometric center G or other like reference point, are altered so as to be translated into coordinates having a center at the block center BC (step 104). This is done by altering these coordinates by an amount corresponding to the linear spacing P and the offset angle Q existing between these points as illustrated in FIG. 7. The translated coordinate values for the selected frame pattern now referenced to the block center BC rather than to the geometric center can be transferred to and used directly by the edging machine 40 for cutting a desired path about the block center BC of the lens blank and block assembly 10 as it is rotated about its center BC in the edging machine (step 109). While in the illustrated example of FIG. 7, the right lens of the eyeglass frame 82 is shown, it should nevertheless be understood that the same procedure is thereafter followed in making the left lens satisfy its prescription data and the pattern data associated with the left frame opening.

Referring back to FIG. 5 and in particular to the illustrated lens blank and block assembly 10, it should be seen that the lens blank 2 is bonded to the block 4 through the intermediary of a layer of bonding material 6 interposed therebetween. The adhesive layer 6 may take the form of any suitable bonding material, but in the preferred embodiment of the invention the layer 6 is formed from a polyester resin with a filler such as magnesium silicate particularly well adapted for this purpose because it is able to be applied and thereafter set with a thickness sufficient to accommodate irregular features on the lens surface, such as in the case of a bifocal segment or with non-spherical zones. The block 4 is comprised of a base portion 8 which may take the form of a generally annularly extending interrupted flange integrally connected with an upstanding generally cylindrical body portion 12 having a diameter usually somewhat less than but at times equal to the diameter of the lens blank 2. By providing a block which supports the lens surface 42 fully, the aforementioned problems associated with supporting the lens during surfacing and cracking and twisting of the lens during the edging process are avoided. The body portion 12 of the assembly 10 is radially inset relative to the base portion 8 so as to give the block 4 a generally hat-shaped appearance when seen in side view. The base portion 8 and the body portion 12 each has its center coincident with the other and with the block center BC of the assembly 10 such that both the base and cylindrical portions are symmetrical about the block center BC. The block 4 may be formed from any material capable of being readily cut together with the lens blank 2 in the edging machine 40, but in the preferred embodiment is formed from reaction injection molded rigid urethene.

Figure 9:
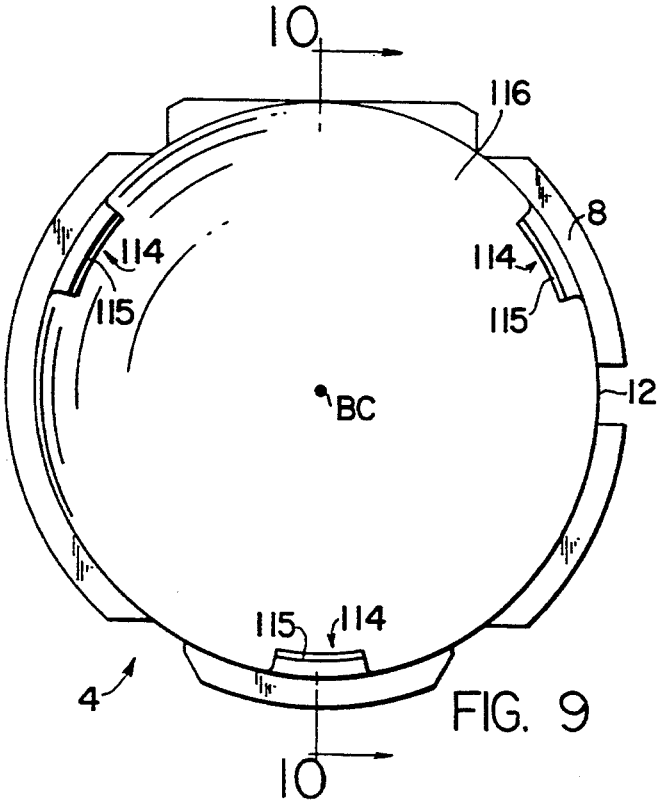
FIG. 9 is a top plan view of the block without the lens blank attached to it.
Figure 10:
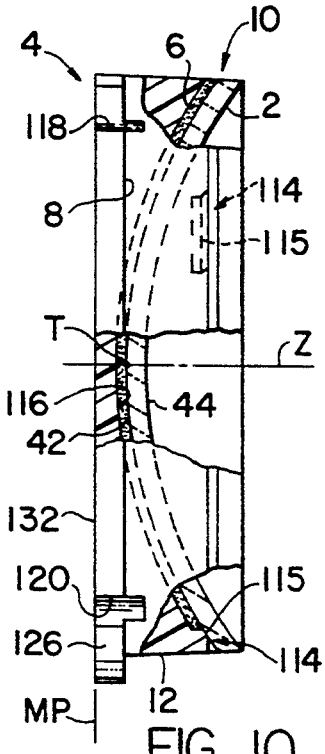
FIG. 10 is a side elevation view taken in section along line 10—10 in FIG. 9 and shows the relationship between the block and the lens blank mounted to it.

In FIGS. 9 and 10 it should be seen that the body portion 12 of the assembly 10 has formed in it an indentation 116 defined by a concave surface having the general contour the finished surface 42 of the lens blank. The lens blank 2 is supported at a fixed distance from a plane MP containing the rear surface 132 of the block 4 by support means 114 allowing the finished surface 42 of the blank to be located at a known distance from the plane MP. The support means 114 takes the form of three equidistantly spaced tabs each having a support surface 115 extending generally parallel with a spherical segment of the indentation surface 116 underlying it so as to provide a three point support for the lens blank 2 while adhesive layer 6 is curing. In forming the assembly 10, a quantity of uncured bonding material 6 is applied to the surface of the indentation 116 and thereafter the two confronting surfaces of the lens blank and the block are forced together against the bonding material interposed therebetween such that the lens center is coincident with the block center BC and the lens blank is supported by each of the tabs comprising the support means 114. Since precision cutting of the inner or work surface 44 of the lens blank 2 by the tool 50 requires that the surface 44 of any given lens be located along the Z axis at a given point such that a lens surface end point T can be established for a given lens blank, the support means 114 ensures such uniform registration between the lens 2 and the block 4 by spacing the surface 42 from block 4 at a fixed distance. Thus, for a given curvature in the surface 42 the cutter tool 50 may precisely move in and out along the Z coordinate axis relative to the point T so as to cut a depth into the blank any point along the surface 44.

Figure 12:
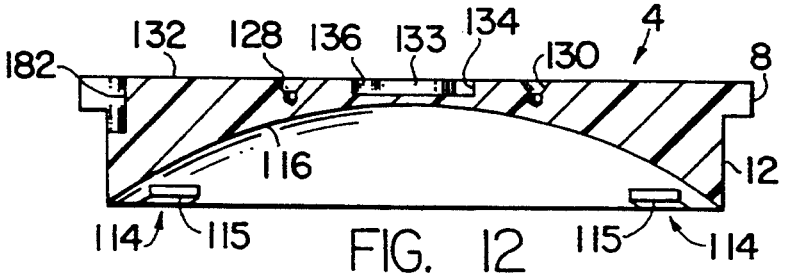
FIG. 12 is a sectional view taken along line 12—12 in FIG. 11 and illustrates in cross section the block mounting means for the finishing and edging apparatus.
Figure 11:
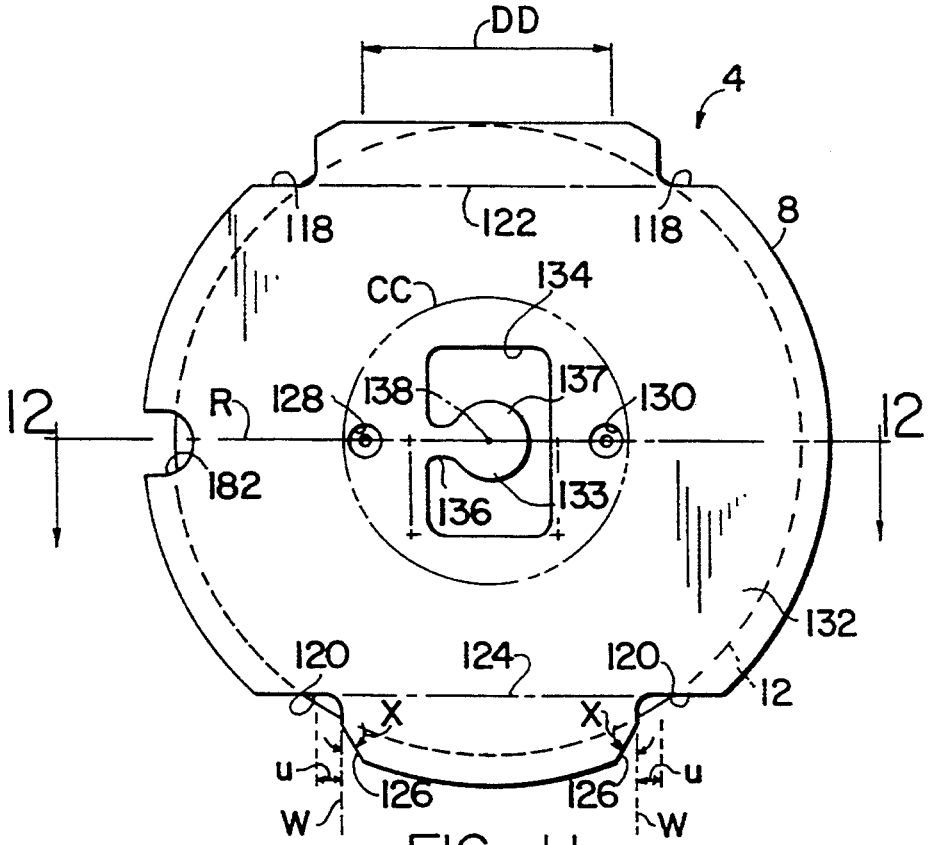
FIG. 11 is a view of the side of the mounting block opposite that shown in FIG. 10 and depicts the various means for connecting the block to the different apparatus shown in FIGS. 1–3.

Referring now to FIGS. 11 and 12, the lens blank and block assembly 10 of the present invention being adaptable for use in any of the three apparatus discussed with reference to FIGS. 1–3 above, is provided with means by which it may be readily mounted in each machine in lens forming process. For the purpose of mounting the assembly 10 in the cutting machine 14, the generally annularly extending base portion 8 of the block 4 has an interrupted periphery made so by a first pair of cutouts 118,118 disposed along a chord 122 extending parallel to the reference axis R containing the block center BC. Similarly, a second pair of cutouts 120,120 are formed in the block 4 and are inwardly directed from the perimeter of the base portion 12 along a chord 124 extending generally parallel to the chord 122. As shown in FIG. 11, the second cutout pair 120,120 is directed inwardly along its associated chord a greater amount than that of the first pair by the indicated dimension u measured from a plane containing the end edges of the first cutout pair 118,118 taken perpendicularly to the first chord 122.

For aiding in mounting of the assembly 10 to the machine 14, a segment of the base portion 8 disposed between the first cutout pair and along the cord 124 has it lateral edges tapered inwardly from a plane W extending generally transversely to the cord 124 so as to form chamfers 126,126 disposed relative to the plane W. As indicated by the angle X, the chamfers 126, 126 are disposed relative to the plane W at a relatively small angle, equal for example to approximately 30 degrees. It should be understood here that the first and second cutout pairs are adapted to receive pins mounted on the chuck 36 for holding the block assembly 10 against rotation during the surfacing process. Additionally, it will be appreciated that the chamfers 126,126 are provided for quickly indexing and loading the assembly onto the chuck 36.

The rear surface 132 of the block 4 is substantially planar and includes means for mounting the assembly 10 to the upper member 100 of the finishing apparatus shown in FIG. 5. For this, two generally conical recesses 128 and 130 are formed in the block such that each recess tapers upwardly from a point within the block 4 and ends in the plane coincident with the surface 132. The recesses 128 and 130 are spaced apart from one another a distance equal to the dimension indicated as DD which distance being the standard spacing between mounting pins fixed to the member 100 of conventional finishing machines for the purpose of engaging with such recesses.

As discussed previously with reference to the edging machine 40, the assembly 10 is adapted to be drivingly rotated about the axis of rotation B during an edging operation. For this, a lug member 133 is provided on the rear face of the block 4 and is surrounded by a generally rectangular pocket 134 for receiving a correspondingly sized and shaped implement carried by of the mounting chuck 78 in the edging machine 40. The pocket 134 defines the particular configuration of the lug 133 such that the outer surface of the lug lies coplanar with the block surface 132. The depth by which the pocket 134 extends into the block 4 from the surface 132 may vary, but in the preferred embodiment it is preferably equal to about 0.06 inch. The lug 133 has a generally circular central portion 137 having its center point at 138 which is coincident with the block center BC. For locating the block assembly 10 at a given orientation on the mounting chuck 78 in the edging machine 40, a tab portion 136 is integrally formed with the central portion 137 and is radially directed outwardly from the center point 138 along the reference axis R for mating with a correspondingly sized slot in the implement carried by the chuck 78. A circle CC circumscribes the recesses 128,130 and the pocket 134 so as to define a region on the surface 132 extending radially outwardly therefrom in which region the surface is non-interrupted allowing a vacuum seal to be effected as will hereinafter become apparent.

Figure 13:
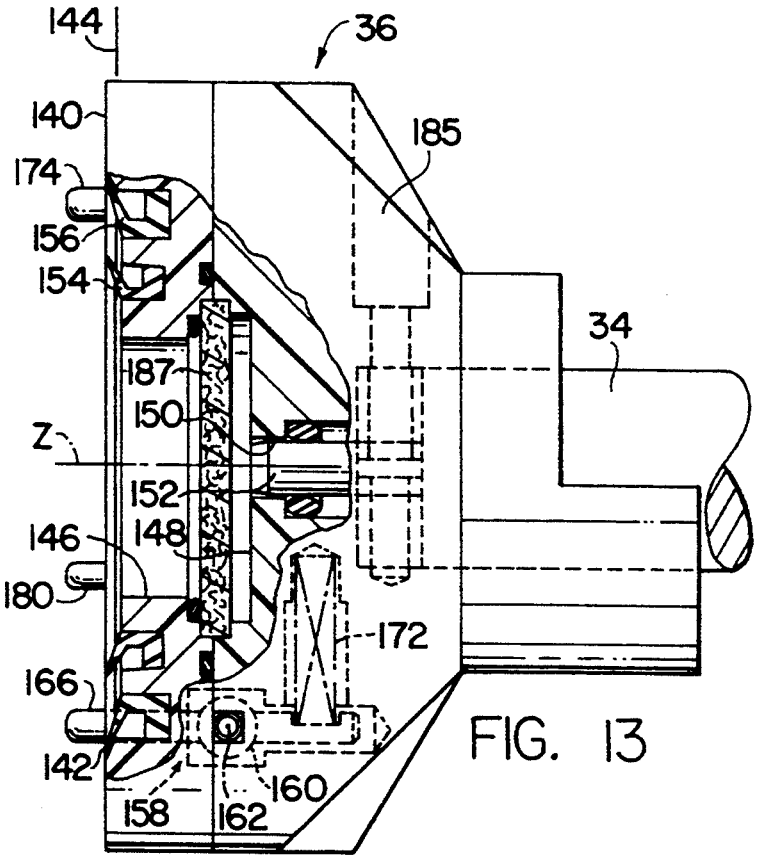
FIG. 13 is a side partially fragmentary view of the chuck used in the cutting apparatus of FIG. 1.

In keeping with the invention, the chuck 36 employed in the cutting machine 14 and as shown in detail in FIG. 13 has a generally flat mounting face 140 upon which is supported the generally flat surface 132 of the block 4. Extending radially inwardly from the mounting face 140 is an annular depression 142 defined by the mounting face 140 and a plane 144 set back from the mounting face 140. Radially directed inwardly from the face 140 and concentrically with the central Z axis is a generally cylindrical first opening 146 extending axially inwardly from the mounting face 140 and ending in a shoulder 148 within the body 185 of the chuck 36. Formed in the shaft 34 is an elongated second opening 150 extending concentrically with the Z axis and ending coincidentally with the shoulder 148. The second opening 150 communicates with the generally cylindrical first opening 146. An elongate hollow vacuum tube 152 is received within the second opening 150 and is positioned therein so as to orient one end generally adjacent the shoulder 148. The opposite end of the tube 152 is connected to a vacuum source for drawing air through the chuck from the first opening 146 through a filter 187 in a manner depicted by the illustrated arrows. To insure that the article mounted to the chuck is in sealing engagement with it, a first annular seal 154 is provided and is disposed concentrically about the Z rotational axis and located generally adjacent the first cylindrical opening 146 while a second annular seal 156 located radially outwardly therefrom and disposed generally adjacent to and supported by the annular bevel 142 is also provided. The two seal arrangement provides the largest possible vacuum area for accommodating the different types of articles capable of being mounted to the chuck.

To effect quick mounting of either the assembly 10 or the lap blanks in the cutting machine 14, the chuck 36 includes a quick mount means 158 for nonrotatably holding each of these articles on it. For this, the means 158 includes a pivotal bar 160 mounted for rotation along a pivot axis 162 within the chuck body 185 and extending generally transversely to the Z rotational axis. Included with the bar 160 are two pins 164 and 166 each extending outwardly beyond the mounting face 140 and received for movement in generally oval shaped openings 168 and 170 formed in the chuck body. The pins 164 and 166 are biased toward the Z axis by biasing means 172, preferably in the form of a helical compression spring received within a blind opening. A portion of the bar 160 extends away from the surface 140 and beyond it such that this bar portion is engaged by the biasing means 172 to effect positive rotation of the bar 160 and consequently the pins 164 and 166 toward the Z axis. The means 158 cooperates with two opposed spaced apart pins 174,174 fixed in the chuck body 185 and extending beyond the mounting face 140 for holding the opposite ends of the lap 92 or a block 4 in registration with the chuck assembly 36.

Figure 14:
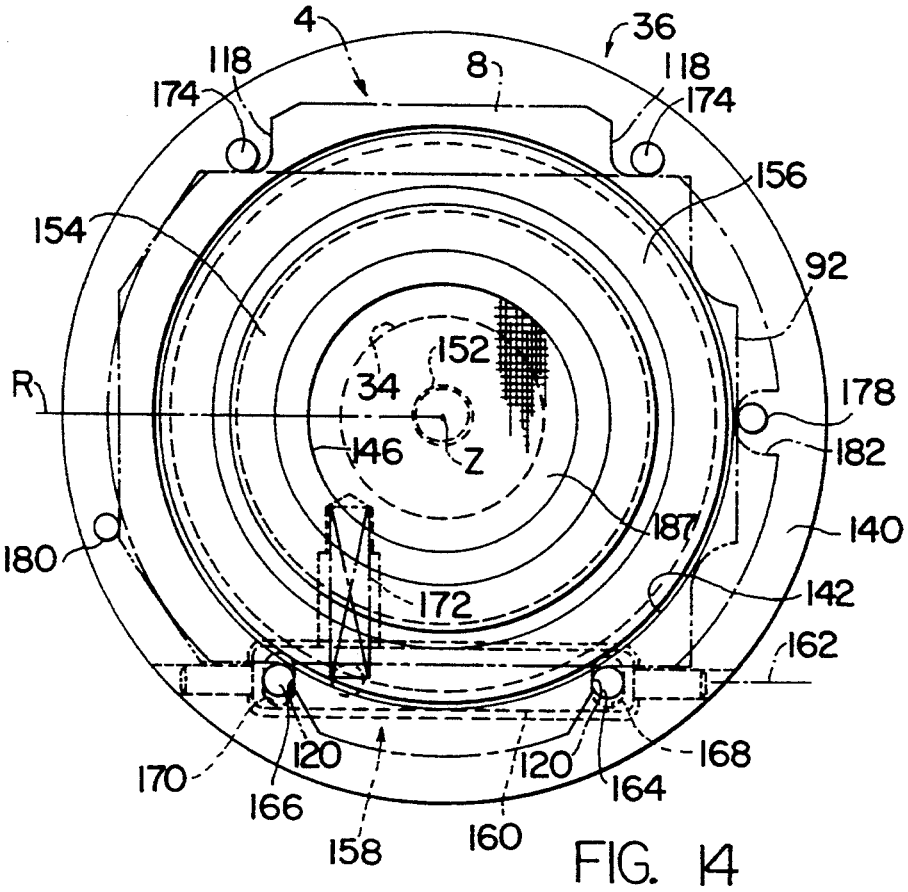
FIG. 14 is a front elevation view showing the chuck of FIG. 13 with a lap blank base and a lens block base superimposed on it for illustration purposes.

In use, an assembly 10 may be readily mounted to the chuck 36 such that the cutouts 120,120 through the aid of the chambers 126,126 are first placed in registry with the pins 164 and 166. Thereafter, upon continued downward movement by the assembly 10, the pins 164 and 166 yield away from the Z axis thereby allowing the cutouts 118,118 to be located in registry with the stationary pins 174,174. The pins 174,174 are located laterally on the chuck 36 at locations corresponding to the spacing between cutouts 118,118 while the pins 164,166 are located a given distance from one another corresponding to the spacing between the cutouts 120,120. These different spacings insure that the block can be mounted on the chuck 36 in a single orientation in which orientation the reference axis R of the assembly 10 is always in registry with an angular initialization point in the machine 14. As shown by the dotted line pattern in FIG. 14 representing the base of a lap blank 92, the arrangement of the pins on the chuck 36 likewise effects positioning of the lap blank such that its center is coincident with the Z axis. To further ensure registration of the lap blank 92 on the chuck 36 in this manner, two additional locating pins 178 and 180 are provided for holding the blank 92 against lateral movement. It should be appreciated that pin 178 being located within the circumference covered by the base portion 8 of the block 4 requires that an associated cutout shown in FIG. 11 as 182 be formed in the base portion of the block 4 to permit clearance this pin when the block is mounted to the chuck. Accordingly, a mounting means generic to both the disposable lap 92 and the block 4 is provided in the chuck 36 of the lens surface cutting machine 14.

By the foregoing a system and associated method and its related article have been disclosed by way of numerous aspects of the present invention. While the same have been illustrated and described in the preferred embodiment and in considerable detail, the invention is subject to alteration and modification without departing from the underlying spirit of the invention. For example, in the preferred embodiment, the block 4 and the associated adhesive layer are disclosed as being formed separately, both of which are readily cut in the cutting operation. However, it is conceivable that the lens blank and block assembly may be molded unitarily as one piece from a bonding material made sufficiently strong and with appropriate recesses and cutouts to be adapted for use in this system. Accordingly, the present invention has been described by way of example rather than limitation.

What is claimed is:

1. A system for shaping the rear surface of a lens blank, for polishing said rear surface and for edging a given shape into the blank for fitting into a selected frame opening of an eyeglass pair, said system comprising:

a lens blank and block assembly, said lens blank of said assembly having a first finished surface facing the block and a second rear surface facing away from the block, the first surface being fixedly bonded with said block such that the centers of the block and the lens are coincident with one another and define a block center;

cutting means for cutting a given shape in the rear surface of said lens blank by rotating said assembly about a cutting axis of rotation coincident with said block center to cause the lens blank to have the optical characteristics specified by prescription data;

said cutting means including a rotatable holding means for releasably mounting said assembly to said machine such that said block center is located coincidentally with said cutting axis of rotation and is disposed at a given angular orientation coincident with a given radial reference axis;

control means associated with said cutting means for creating a custom lap for off-axis finishing of the worked on second surface of said lens blank such that the custom lap is formed with a surface correspondingly shaped to fit the given shape cut in the rear surface of the lens and means for holding said custom lap in said cutting means at a given orientation with respect to said block center and said given radial reference axis in said cutting machine;

means formed on said assembly for holding it in registry with means for finishing said second surface of said lens regardless of the surface contour formed thereon and for orienting said assembly with respect to said custom lap while said assembly is mounted in said finishing means such that the cut surfaces of said lap and said lens blank mate with each other;

edging means for edging a given shape in said lens blank while fixed to said block assembly and rotated relative to an edging tool about an edging means central axis; and means provided on said block for mounting said assembly to said edging means for rotation about said edging means central axis such that the edging means central axis is located coincidentally with said block center and said block is angularly oriented on said edging means relative to said given radial reference axis whereby said edging of said block and lens blank assembly is accomplished without re-blocking after said lens second surface is cut and finished.

2. A system as defined in claim 1 further characterized in that said lens blank and block assembly is held together by a layer of bonding material interposed therebetween; and wherein said block is formed from a material readily cuttable by said edging means.

3. A system as defined in claim 2 further characterized in that said means for holding said lens blank and block assembly in said cutting machine includes cutouts formed about the periphery of said assembly for holding it at a given orientation relative to the cutting machine.

4. A system as defined in claim 3 further characterized in that said means for rotatably mounting said lens blank and block assembly to said edging means includes a lug shaped portion outlined by a pocket formed in said block for receiving a correspondingly sized and shaped portion of said edging machine.

5. A system as defined in claim 1 further characterized by said block having a base portion integrally connected with a body portion; and said body portion having an indentation formed it for receiving the general spherical contour of the front surface of a lens blank.

6. A system as defined in claim 5 further characterized in that said block includes a first pair of cutouts formed along a first chord in the body portion of said block and a second pair of cutouts formed along a second chord extending parallel to the first chord;

each of said first and said second chords being oriented generally parallel with said given radial axis.

7. A system as defined in claim 6 further characterized in that said second pair of cutouts extend inwardly from the outer periphery of said block a greater distance than do the cutouts of said first pair.

8. A system as defined in claim 6 further characterized in that said second pair of cutouts each define a portion on said body portion having a chamfered edge taken relative to a plane extending generally perpendicularly to the reference axis of the block.

9. A system as defined in claim 6 further characterized in that the block has a substantially flat surface oppositely facing the direction in which said indentation opens, said surface having a pocket formed in it, said pocket further disposed between two spaced apart recesses formed in said surface; and wherein said pocket is of a generally rectangular shape and the length of which rectangle is included within a circle circumscribing the outer limits of each of said recesses.

10. A system as defined in claim 9 further characterized in that said pocket extends into the block from said flat surface and defines a lug member having a generally circular portion and a radially directed tab portion integrally connected with the remaining block material.

11. A system as defined in claim 10 further characterized in that said indentation formed in said body portion is generally spherical and disposed about said spherical indentation and formed as part of said body portion are a plurality of equidistantly spaced apart support means for supporting the front surface of said lens blank away from the block at a known distance.

12. A system as defined in claim 6 further characterized in that said body portion is generally cylindrically shaped and said indentation has a generally spherical surface and disposed about said indentation formed in said body portion are plurality of equidistantly spaced apart support means for supporting the front surface of said lens blank away from the block at a known distance.

13. A system as defined in claim 6 further characterized by said block being formed from a cuttable material.

14. A system as defined in claim 13 further characterized by said cuttable material being a reaction injection molded rigid urethene.

15. A system as defined in claim 1 further characterized by said lens blank having a generally spherical front surface and a rear surface;

said block having a base portion and a body portion integrally connected therewith, said body portion having an indentation formed therein for receiving the generally spherical front surface of said lens blank;

said lens blank being fixed to and being arranged on said block coincident with the center of said body portion and with said cutting axis of rotation and with reference to said radial axis extending generally perpendicularly to said cutting reference axis so as to allow said assembly to be mounted in a number of machines.

16. A system as defined in claim 15 further characterized in that said body portion is generally cylindrical and said indentation is defined by a concave generally spherical surface; and said block includes spacing means for supporting said spherical front surface of said lens blank from said block at a known distance.

17. A system as defined in claim 16 further characterized in that said spacing means includes at least three equidistantly spaced tabs located about said indentation and above said surface defining it.

18. A system as defined in claim 17 further characterized by a layer of bonding material interposed in said indentation between said lens blank front surface and said body portion for fixing said lens blank to said block assembly; and said adhesive layer is formed from a polyester resin having a filler.

19. A system as defined in claim 18 further characterized in that said adhesive layer is formed from an adhesive including magnesium silicate.

20. A system as defined in claim 15 further characterized in that said base portion is generally annular and said mounting means includes a first and second pair of cutouts arranged along first chord in said base portion extending generally parallel to said radial reference axis and includes a second pair of cutouts arranged along a second chord extending generally parallel to said first chord.

21. A system as defined in claim 20 further characterized in that said body portion has a substantially flat mounting surface facing away from the direction in which said indentation opens;

said mounting means further including a pocket formed in said base portion and ending in said mounting surface, said pocket further defining a lug member having means for insuring registration of said assembly with corresponding cutting and radial axes.

22. A system as defined in claim 1 further characterized by said rotatable holding means including a chuck having a body portion having a planar mounting face for engaging with and supporting an article held against it;

a generally first opening formed in said body portion extending from said mounting face axially inwardly therefrom and into said body portion, said first opening being concentric with said axis of rotation of said chuck;

means for communicating air through said body portion and to said first openings to cause air to be drawn from said first opening and through said body portion to a vacuum source;

means for maintaining the sealing engagement between the block and said mounting surface; and locating means for automatically orienting the assembly at a given angular orientation relative to said cutting axis and said radial axis.

23. A system as defined in claim 22 further characterized in that said seal means includes first seal and a second seal each oriented concentrically about said axis of rotation of said chuck; and said first seal being located radially inwardly of said second seal.

24. A system as defined in claim 23 further characterized by said first seal being oriented generally adjacent said first opening in said block and said second seal being located generally adjacent and inwardly directed from an annular bevel supporting it for sealing engagement with an article.

25. A system as defined in claim 22 further characterized in that said locating means includes two pairs of pins arranged about said chuck along cords extending generally parallel to said radial axis; and wherein said first pair of pins being stationary relative to said chuck and said second pair of pins being pivotally mounted relative to said first pair of pins and releasably engaging an article supported thereby.

26. A system as defined in claim 25 further characterized by said first pair of pins being spaced apart from one another by a first distance and said second pair of pins being spaced apart from one another by a second distance; and wherein said first and said second distances are unequal.

27. A system as defined in claim 22 further characterized in that said locating means includes a first pair of pins fixed on said block and a second pair of pivotally mounted pins urged toward said first pair of pins by a biasing means housed within said body portion of said chuck.

28. A system as defined in claim 27 further characterized in that said pins comprising said second pair are mounted on a bar rotatable about a pivotal axis extending generally perpendicularly to the axis of rotation of said chuck; and at least one of said pins comprising said second pair extending away from said assembly mounting surface and beyond said pivotal axis and engaged by biasing means.

29. A system as defined in claim 27 further characterized by said locating means including a third pair of locating pins located oppositely one another along either side of the direction with which the second pin pair is urged toward said first pin pair for holding said assembly against lateral movement.

* * * * *